US010436184B2

(12) United States Patent
Porarinsson

(10) Patent No.: US 10,436,184 B2
(45) Date of Patent: Oct. 8, 2019

(54) HYDRAULIC DEVICE

(71) Applicant: Danfoss A/S, Nordborg (DK)

(72) Inventor: Sveinn Porarinsson, Reykjavik (IS)

(73) Assignee: DANFOSS A/S, Nordborg (DK)

( * ) Notice: Subject to any disclaimer, the term of this patent is extended or adjusted under 35 U.S.C. 154(b) by 658 days.

(21) Appl. No.: 15/017,699

(22) Filed: Feb. 8, 2016

(65) Prior Publication Data

US 2016/0230749 A1 Aug. 11, 2016

(30) Foreign Application Priority Data

Feb. 11, 2015 (EP) ..... 15154615

(51) Int. Cl.
*F04B 1/20* (2006.01)

(52) U.S. Cl.
CPC ..... *F04B 1/2042* (2013.01); *F04B 1/2021* (2013.01)

(58) Field of Classification Search
CPC ..... F04B 1/2042; F04B 1/2021; F04B 1/324; F16H 61/46
See application file for complete search history.

(56) References Cited

U.S. PATENT DOCUMENTS 3,585,901 A * 6/1971 Moon, Jr. ..... F04B 1/2021 417/312
3,699,845 A * 10/1972 Ifield ..... F04B 1/2042 91/499
4,920,856 A * 5/1990 Berthold ..... F04B 1/2042 91/499
6,640,687 B1 * 11/2003 Frantz ..... F04B 1/2042 417/222.1

FOREIGN PATENT DOCUMENTS

| | | | |
|---|---|---|---|
| CN | 100371596 | C | 2/2008 |
| DE | 1 198 203 | B | 8/1965 |
| DE | 26 01 970 | A1 | 7/1977 |
| DE | 40 35 748 | A1 | 5/1991 |
| EP | 0679227 | B1 | 4/1997 |
| EP | 2 669 516 | A1 | 12/2013 |
| GB | 982 314 | | 2/1965 |
| GB | 2 056 576 | A | 3/1981 |

* cited by examiner

*Primary Examiner* — Dominick L Plakkoottam
(74) *Attorney, Agent, or Firm* — McCormick, Paulding & Huber LLP

(57) ABSTRACT

A hydraulic device 1 comprises a first member 2 movable relative to a second member 5. In such a device the risk of cavitation noise and cavitation damage should be minimized. To this end said first member 2 having a pressure chamber 3 opening in a face 7 of said first member 2 which face 7 is in contact with a contact face 6 of said second member 5, said second member 5 having a low pressure area 9, wherein a throttling flow path is provided in a groove 11 connecting said pressure chamber 3 and said low pressure area 9 when pressure chamber 3 is approaching said low pressure area 9, characterized in that a throttling resistance of said groove 11 increases in a direction of the flow through said groove 11.

20 Claims, 2 Drawing Sheets

HYDRAULIC DEVICE

CROSS REFERENCE TO RELATED APPLICATION

Applicant hereby claims foreign priority benefits under U.S.C. § 119 from European Patent Application No. EP15154615.7 filed on Feb. 11, 2015, the content of which is incorporated by reference herein.

TECHNICAL FIELD

The present invention relates to a hydraulic device comprising a first member movable relative to a second member, said first member having a pressure chamber opening in a face of said first member which is in contact with a contact face of said second member, said second member having a low pressure area, wherein a throttling flow path is provided in a groove connecting said pressure chamber and said pressure area when said pressure chamber is approaching said low pressure area.

BACKGROUND

Such a hydraulic device is known, for example, from EP 0 679 227 B1.

The throttling flow path is used to produce a pressure equalization to avoid problems that can occur during the transition from a relatively high pressure in the pressure chamber to a relatively low pressure in the low pressure area.

In some cases, cavitation noise and cavitation damage can be observed when a liquid filled volume, i.e. the pressure chamber, is depressurized through the throttling flow path connected to the low pressure area.

SUMMARY

The object underlying the invention is to reduce the risk of cavitation noise and cavitation damage in the hydraulic device.

This object is solved in a hydraulic device as described at the outset in that a total throttling resistance of the flow path increases during the duration of the throttling.

When a fluid volume is depressurized through the throttling flow path the pressure differential sets the fluid in motion so that fluid flows through the throttling flow path from the high pressure area within the pressure chamber towards the low pressure area. The pressure differential that drives the fluid through the throttling flow path decreases during the throttling. However, due to the inertia of the fluid, the flow through the throttling flow path tends to continue even after pressure equalization has been achieved. This causes the risk that the pressure in the pressure chamber undershoots the pressure in the low pressure area. If the pressure difference between the initial high pressure in the pressure chamber and the low pressure in the low pressure area is substantially larger than the pressure difference between the low pressure area and the vapor pressure of the liquid, then there is risk that the pressure in the pressure chamber reaches the vapor pressure of the liquid so that cavitation bubbles are formed. When these bubbles are subjected to increasing pressure, they can implode and cause cavitation noise and cavitation damage to the structural materials of the device. When, however, during the throttling the throttling resistance of the flow path increases, the liquid passing the throttling flow path is slowed by the increasing flow resistance so that the undershooting of the low pressure level in the low pressure area can be avoided or at least kept small. The risk that vapor develops can be avoided. During the throttling a pressure equalization is permanently possible. However, the velocity and therefore the kinetic energy of the fluid flowing through the flow path is reduced thus preventing undershooting.

In a preferred embodiment a throttling resistance of said groove increases in a direction of flow through said groove. In other words, the differential throttling resistance per unit of length increases. The increase of the throttling resistance of the groove is a simple way to increase the total resistance of the throttling flow path.

Preferably, a hydraulic diameter of said groove decreases in a direction of flow through said throttling flow path. The hydraulic diameter is one factor influencing the throttling resistance of the throttling flow path.

This can be realized in a preferred embodiment in that a flow area of said groove decreases in a direction of flow through said throttling flow path. This is a rather simple means, which can easily be produced.

In a preferred embodiment, said groove is located in said contact face of said second member contacting said first member. Such a groove can easily be machined. When this groove is only partly covered by the first member, in other words when the groove is in overlapping relation with the pressure chamber, the throttling flow path is established.

In this respect, it is preferred that a width of said groove perpendicular to a moving direction of said first member relative to said second member decreases in a direction of flow through said throttling flow path. This is a simple means to decrease the flow area.

In an additional or alternative embodiment a depth of said groove perpendicular to said contact face decreases in a direction of flow through said throttling flow path. This as well is a possibility to decrease the flow area of the throttling flow path in direction of flow.

In a preferred embodiment, said groove has a form of a triangle in said contact face. In other words, when said contact face is viewed from the side on which the first member is arranged, the groove has a form of a triangle.

In an alternative or additional embodiment, it is preferred that said groove has a section perpendicular to said face in form of a triangle. It is therefore possible to linearly reduce the depth of the throttling groove towards the location where the groove contacts the low pressure area or it is possible to keep constant the depth and give the groove the form of a triangle or it is possible to use a combination of both.

Preferably, said first member comprises at least two pressure chambers which are separated by a wall, wherein a thickness of said wall in direction of movement of said first member relative to said second member is smaller than a length of said throttling flow path. When the wall between the two pressure chambers has been moved over the throttling flow path, there is always a connection between the two pressure chambers. However, when the wall is moved towards the low pressure area, the pressure resistance of the flow path increases.

BRIEF DESCRIPTION OF THE DRAWINGS

A preferred embodiment of the invention will now be described in more detail with reference to the drawing, wherein.

DETAILED DESCRIPTION

Figure 1:
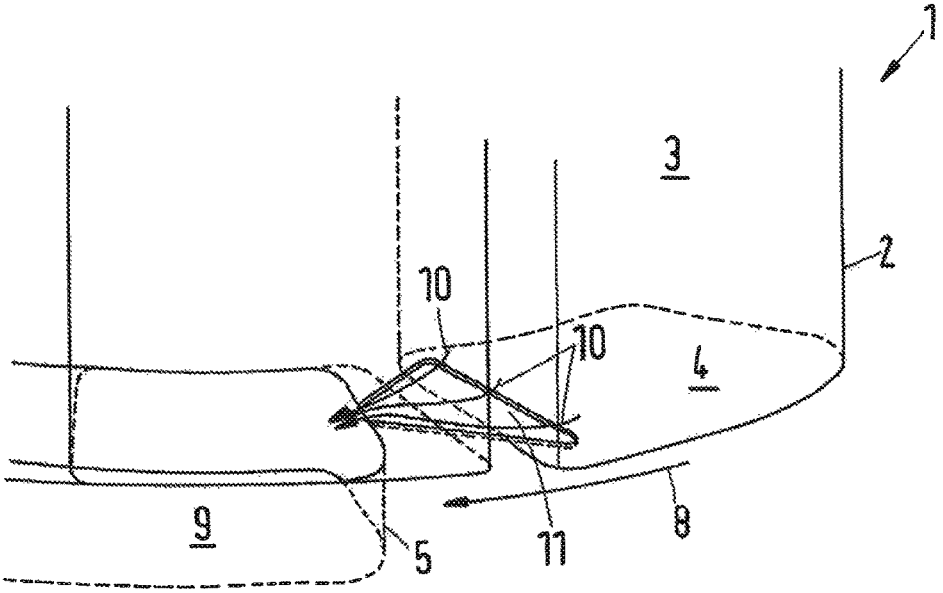
FIG. 1 is a schematic illustration helping to explain the invention.

FIG. 1 schematically shows some parts of a hydraulic device 1 which can be realized, for example, by an axial piston pump or a pressure exchanger. The hydraulic device 1 comprises a first member 2. A pressure chamber 3 is formed in said first member 2. The pressure chamber 3 has an opening 4. A liquid within the pressure chamber 3 can be pressurized, for example, by means of a piston (not shown).

The hydraulic device 1 furthermore comprises a second member 5. The first member 2 and the second member 5 contact each other, i.e. a second member 5 has a contact face 6 against which a face 7 of the first member rests. The first member 2 is movable relative to the second member 5 in a direction 8 shown by an arrow. In the present example the first member 2 is rotated relative to the second member 5.

The second member 5 has a low pressure area 9. When the opening 4 of the pressure chamber 3 approaches the low pressure area 9, a throttling flow path 10 is established in order to enable a pressure equalization between the pressure chamber 3 and the low pressure area 9 before the pressure chamber 3 comes in full overlapping relation with the low pressure area 9. The throttling flow path 10 is illustrated by a number of arrows.

The throttling flow path 10 is established by means of a groove 11 formed in the contact face 6 of the second member 5. This groove 11 has the form of a triangle when viewed from the first member 2. In other words, the width of the groove 11 perpendicular to the moving direction 8 of the first member 2 relative to the second member 5 decreases in a direction of flow through the throttling flow path 10. Such a triangle is chosen because it is simple to machine. However, other forms of the groove 11 are possible as soon as the width decreases in moving direction 8. In this case, the groove 11 can have a constant depth, wherein the depth is the direction perpendicular to the contact face 6.

In another embodiment not shown in the drawing, the groove 11 can have a depth which decreases in moving direction 8, i.e. in direction of flow through said throttling flow path 10. In this case, the width of the groove 11 can be kept constant.

However, it is possible to combine both possibilities, i.e. to have a decreasing width and a decreasing depth in moving direction 8.

The decreasing depth 11 can be realized as well by a triangle section.

Figure 2:
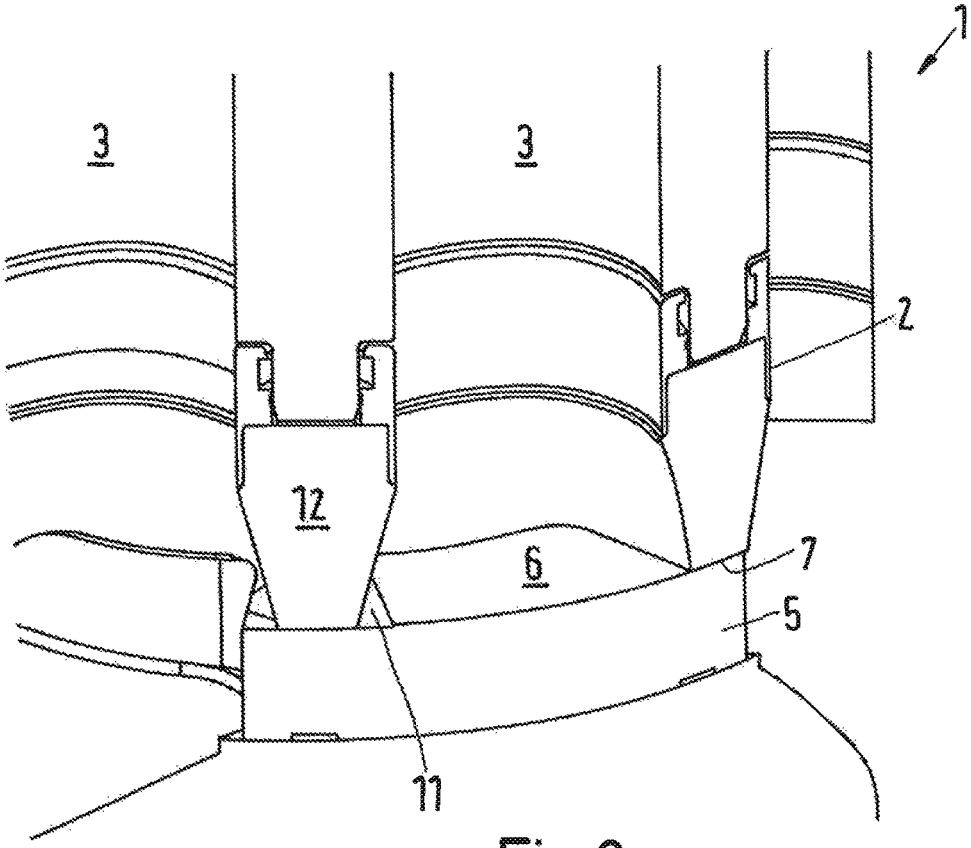
FIG. 2 is a perspective view of a part of a hydraulic device.

As can be seen in FIG. 2, the first member 2 has not only one pressure chamber 3, but two pressure chambers 3. The two pressure chambers 3 are separated by a wall 12. The thickness of the wall 12 at face 7, i.e. in a region contacting contact face 6, is smaller than the length of groove 11 in direction 8 of motion. As soon as the wall 12 comes in overlapping relation with groove 11, the throttling flow path 10 is established.

In this case a throttling flow path 10 has a first section, which is in communication with the pressure chamber 3 under high pressure and a second section, which is in communication with the next pressure chamber 3 with low pressure. When the wall 12 moves in direction 8 of rotation, the cross-section of the flow path 10 in the second section through which the fluid can escape to the pressure chamber 3 under low pressure decreases and therefore the throttling resistance of the throttling flow path 10 increases slowing down the flow of liquid and therefore the kinetic energy of the fluid.

Figure 3A:
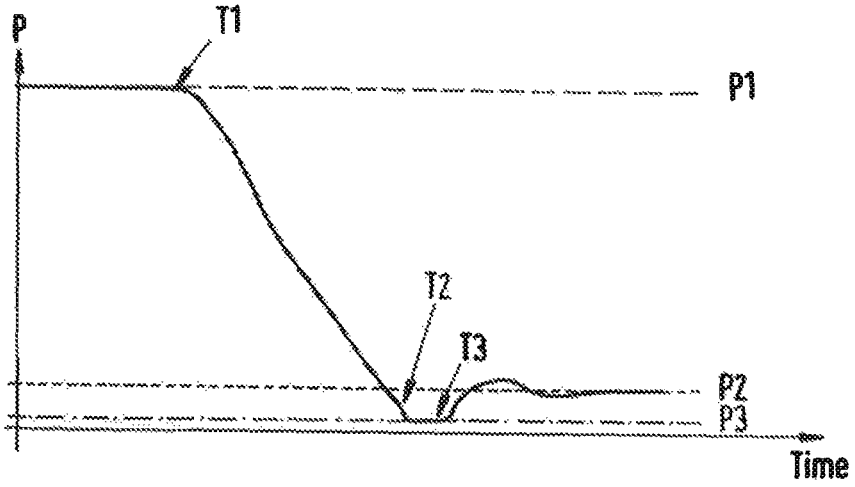
FIG. 3A is an illustration comparing showing a pressure behavior according to the state of the art.

The effect of such an increasing differential flow resistance of the throttling flow path 10 is explained in connection with FIGS. 3A and 3B. FIG. 3A shows the situation in conventional hydraulic devices. The horizontal axis shows time and the vertical axis shows pressure P. Pressure P1 is the high pressure level in pressure chamber 3 when no throttling flow path 10 is established. Pressure P2 is the low pressure level in low pressure area 9 and pressure P3 is the vapor pressure level of the liquid. At time T1 depressurization begins. The pressure decreases from pressure level P1. At time T2 there is an undershoot in pressure caused by fluid inertia. Since the pressure decrease can continue until a time T3 there is a possible formation of cavitation bubbles. After this time T3, there is an equalization, i.e. the pressure rises to the pressure level P2, i.e. the low pressure in the low pressure area 9. The cavitation bubbles can implode thereby leading to adverse cavitation.

Figure 3B:
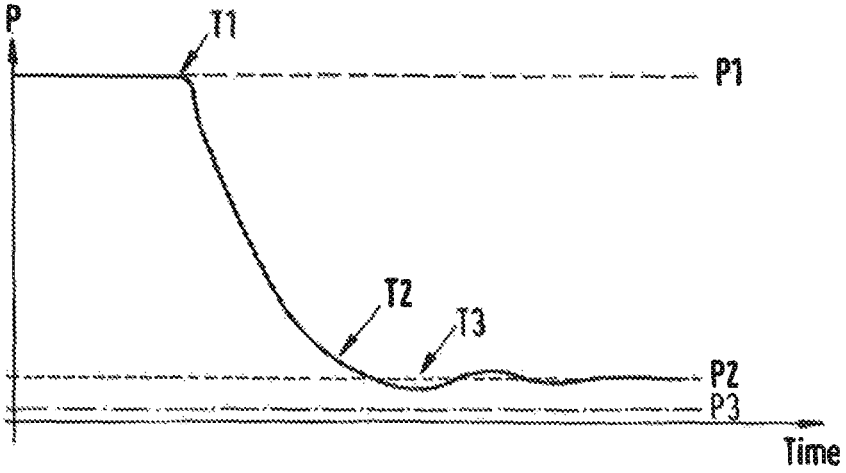
FIG. 3B is an illustration showing a pressure behavior according to the invention.

FIG. 3B shows the situation achieved with the groove 11 illustrated above. At time T1 the depressurization begins. The pressure decreases. However, because of the special form of groove 11 and the increasing differential throttling resistance, the throttling is slow at time T2 by increasing flow resistance. Although there is a small undershoot in pressure at time T3, the pressure does not fall below the vapor pressure of liquid P3.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic device comprising a first member movable relative to a second member, said first member having a pressure chamber opening in a face of said first member which face is in contact with a contact face of said second member, said second member having a low pressure area, wherein a throttling flow path is provided in a groove connecting said pressure chamber and said low pressure area when said pressure chamber is approaching said low pressure area, wherein a total throttling resistance of the throttling flow path increases in a direction from the pressure chamber towards the low pressure area during the duration of the throttling.

2. The hydraulic device according to claim 1, wherein a throttling resistance of said groove increases in a direction of the flow through said groove.

3. The hydraulic device according to claim 1, wherein a hydraulic diameter of said groove decreases in a direction of flow through said throttling flow path.

4. The hydraulic device according to claim 1, wherein a flow area of said groove decreases in a direction of flow through said throttling flow path.

5. The hydraulic device according to claim 1, wherein said groove is located in said contact face of said second member contacting said first member.

6. The hydraulic device according to claim 1, wherein a width of said groove perpendicular to a moving direction of said first member relative to said second member decreases in a direction of flow through said throttling flow path.

7. The hydraulic device according to claim 1, wherein a depth of said groove perpendicular to said contact face decreases in a direction of flow through said throttling flow path.

8. The hydraulic device according to claim 1, wherein said groove has a form of a triangle in said contact face.

9. The hydraulic device according to claim 1, wherein said groove has a section perpendicular to said contact face in form of a triangle.

10. The hydraulic device according to claim 1, wherein said first member comprises two pressure chambers which are separated by a wall, wherein a thickness of said wall at the face of the first member in direction of movement of said first member relative to said second member is smaller than a length of said groove.

11. The hydraulic device according to claim 2, wherein a hydraulic diameter of said groove decreases in a direction of flow through said throttling flow path.

12. The hydraulic device according to claim 2, wherein a flow area of said groove decreases in a direction of flow through said throttling flow path.

13. The hydraulic device according to claim 3, wherein a flow area of said groove decreases in a direction of flow through said throttling flow path.

14. The hydraulic device according to claim 2, wherein said groove is located in said contact face of said second member contacting said first member.

15. The hydraulic device according to claim 3, wherein said groove is located in said contact face of said second member contacting said first member.

16. The hydraulic device according to claim 4, wherein said groove is located in said contact face of said second member contacting said first member.

17. The hydraulic device according to claim 2, wherein a width of said groove perpendicular to a moving direction of said first member relative to said second member decreases in a direction of flow through said throttling flow path.

18. The hydraulic device according to claim 3, wherein a width of said groove perpendicular to a moving direction of said first member relative to said second member decreases in a direction of flow through said throttling flow path.

19. The hydraulic device according to claim 4, wherein a width of said groove perpendicular to a moving direction of said first member relative to said second member decreases in a direction of flow through said throttling flow path.

20. The hydraulic device according to claim 5, wherein a width of said groove perpendicular to a moving direction of said first member relative to said second member decreases in a direction of flow through said throttling flow path.

* * * * *